United States Patent [19]

Bolduc

[11] Patent Number: 5,064,121

[45] Date of Patent: Nov. 12, 1991

[54] DISPENSER

[76] Inventor: Lee R. Bolduc, 6416 Gainsborough Dr., Raleigh, N.C. 27612

[21] Appl. No.: 552,789

[22] Filed: Jul. 16, 1990

Related U.S. Application Data

[63] Continuation-in-part of Ser. No. 419,508, Oct. 10, 1989, Pat. No. 5,012,978, and Ser. No. 251,806, Oct. 3, 1988, Pat. No. 4,941,615.

[51] Int. Cl.[5] ..... B67B 7/24

[52] U.S. Cl. ..... 239/309; 222/80

[58] Field of Search ..... 222/80, 82; 239/309

[56] References Cited

U.S. PATENT DOCUMENTS

| | | |
|---|---|---|
| 315,610 | 4/1885 | Gee . |
| 518,258 | 4/1894 | Lechartier . |
| 1,536,144 | 5/1925 | Robinson . |
| 1,587,598 | 6/1926 | Magg . |
| 1,779,959 | 10/1930 | Bellocchio . |
| 2,167,866 | 8/1939 | Bennett . |
| 2,716,637 | 8/1955 | Bunting . |
| 2,921,720 | 1/1960 | Malachick . |
| 2,930,384 | 3/1960 | Strain et al. . |
| 3,080,094 | 3/1963 | Modderno . |
| 3,236,418 | 2/1966 | Dalle et al. . |
| 3,240,403 | 3/1966 | Modderno . |
| 3,255,924 | 6/1966 | Modderno . |
| 3,349,966 | 10/1967 | Schwartzman . |
| 3,416,707 | 12/1968 | Pollard . |
| 3,416,709 | 12/1968 | Shultz et al. . |
| 3,491,916 | 1/1970 | Graham . |
| 3,591,089 | 7/1971 | Cronan . |
| 3,638,786 | 2/1972 | Borecki et al. . |
| 3,648,899 | 3/1972 | Lukesch et al. . |
| 3,658,719 | 4/1972 | McConnaughey . |
| 3,679,102 | 7/1972 | Charle et al. . |
| 3,718,235 | 2/1973 | Cronan . |
| 3,773,264 | 11/1973 | Cronan . |
| 3,791,980 | 2/1974 | Goldsmith . |
| 3,966,087 | 6/1976 | Curry et al. . |
| 4,121,772 | 10/1978 | Cronan . |
| 4,201,316 | 5/1980 | Klingaman . |
| 4,387,998 | 6/1983 | Szigeti . |
| 4,465,183 | 8/1984 | Saito et al. . |
| 4,491,250 | 1/1985 | Liebermann . |
| 4,613,061 | 9/1986 | Meuresch et al. . |
| 4,682,689 | 7/1987 | Pereira et al. . |
| 4,779,763 | 10/1988 | Klawitter . |

FOREIGN PATENT DOCUMENTS

| | | |
|---|---|---|
| 1168772 | 12/1958 | France . |
| 215493 | 5/1924 | United Kingdom . |

OTHER PUBLICATIONS

Aerosol Age, Sept. 1985.
Aerosol Age, Apr. 1986.

*Primary Examiner*—Andres Kashnikow
*Assistant Examiner*—Kevin P. Weldon
*Attorney, Agent, or Firm*—Burd, Bartz & Gutenkauf

[57] ABSTRACT

A disperser having a transparent container for storing propellant and a first compound under pressure. A normally closed valve is mounted on top of the container to control the dispensing of the materials from the container. An ampule containing a second material separate from the first material until the ampule is broken is positioned generally diagonally along the length of the container with a holder. A push rod connected to the valve and extended through a generally cylindrical filter surrounding the valve has a conical shaped finger having a lower pointed end engageable with the side wall of the ampule to break the ampule when the valve is first moved to an open position. The materials are mixed within the container and move through the filter before entering the valve. The holder has a plurality of vent holes allowing thorough mixing of the materials and free flow of the materials to the valve. The mixed materials and propellant are dispensed through a spout of a nozzle member mounted on the container when the nozzle member is depressed causing the valve to open.

49 Claims, 5 Drawing Sheets

DISPENSER

CROSS REFERENCE TO RELATED APPLICATIONS

This application is a continuation-in-part of U.S. Pat. application Ser. No. 419,508 filed Oct. 10, 1989 now U.S. Pat. No. 5,012,978, and U.S. Pat. application Ser. No. 251,806 filed Oct. 3, 1988, now U.S. Pat. No. 4,941,615.

FIELD OF INVENTION

The invention relates to containers and dispensers for holding materials which must normally be maintained in separated conditions until immediately prior to use. The dispensers allow mixing of materials and are adapted to dispense the mixed materials as a foamed mousse.

BACKGROUND OF INVENTION

Many compounds would be advantageously used if they could be dispensed from an aerosol container. Some of these compounds have a relatively short shelf life and have components that cannot be intermixed until just prior to use. Separation of the compounds in the container may be necessary to limit pressure within the container. Mixing of the compounds within the container avoids spillage which can change the ratio of the compounds required for a satisfactory product. Aerosol containers that include a frangible secondary container have been used to hermetically separate two chemical ingredients that must be mixed together immediately prior to spraying. An inertia means, such as a steel ball, has been placed in the secondary container so that by shaking the entire aerosol container the inertia means shatters the secondary container allowing the two chemicals to be mixed together allowing a chemical mixture to be sprayed to a desired location. An example of this structure is shown by Cronan in U.S. Pat. No. 4,121,772.

An aerosol package shown and described in *Aerosol Age*, Apr. 1986, has an ampule that keeps the reactive compounds in the system separated until ready for use. When the valve is actuated, the ampule is broken and its contents mix with other chemicals and/or a propellant. The ampule is made of a frangible material, such as glass. A rod mechanism extends from the valve downwardly into the container. The lower end of the rod has a saddle that traps the ampule transversely against the bottom of the container. When the valve stem is depressed, the rod shatters the ampule. This aerosol system allows one to use an aerosol spray containing material having a relatively short shelf life. The size of the ampule lying on the bottom of the container is limited by the diameter of the container and the diameter of the opening into the container.

SUMMARY OF INVENTION

The dispenser of the invention has a container for storing a propellant and materials, such as liquids and chemicals, that are to be discharged to a desired location. The dispenser stores two or more separated materials that are mixed together within the container immediately prior to use. A wide range of ratios of materials can be selected by using different size ampules for storing secondary materials. The dispenser can be effectively used to produce aerosol foam, spray and mousse containing hair care products, such as hair permanents, hair relaxers, hair dyes, hair sunscreens, hair stylers and shampoos. Ampule breaking structure associated with the control valve is manually operated to fracture the ampule thereby allowing the materials in the ampule and container to mix with each other. The container can be made of transparent materials to permit visual inspection of the integrity of the ampule and the contents of the container, such as the color of the hair dye.

The container has an open top that is closed with a cap that supports a normally closed control valve. The control valve has a moveable tubular member which can be manually moved into the container to open the valve to allow propellant and material to be dispensed therefrom. A frangible ampule is located within the container for storing a second material separated and isolated from the first material. The ampule is an elongated closed glass vessel that is positioned diagonally along the diagonal length of the container. The ampule is normally located in a generally diagonal position. An ampule holder mounted on the container has a sleeve with a passage for accommodating a portion of the ampule to retain it in a generally diagonal position. The holder has an annular shoulder that fits into the container to enable the holder to drop into place. The holder can be automatically assembled on the container. Rotational alignment of the holder relative to the container is not required to position the holder on the container. A bracket can be attached to the holder to accommodate a lower portion of the ampule. The ampule breaking structure has a push rod connected to the bottom of the moveable member of the valve. The push rod extends through the valve housing and a filter surrounding and mounted on the bottom portion of the valve housing. The filter prevents foreign material, such as broken glass and the like, from entering the valve and being dispensed from the dispenser. The ampule can be encased within a mesh bag which retains glass particles. The mesh bag facilitates handling of the ampule and functions as a shock absorber in use. The valve housing and filter are used to guide and support the push rod. An actuator is mounted on the outer end of the tubular member. A spout usable to direct materials in the container to a desired location is joined to the top of the actuator. A button is mounted on the outer end of the spout to prevent escape of materials from the container when the tubular member is first moved to break the ampule.

The push rod extends into the passage of the holder adjacent the side of the ampule. The push rod and holder have cooperating surfaces so that when the moveable member is first moved into the chamber the push rod crushes or breaks the ampule whereby the second material is mixed with the first material in the chamber. The holder has a plurality of vent holes to facilitate the mixing of the materials. After the ampule is broken, the actuator is used to operate the valve in a normal manner to dispense the mixed materials as a foam, spray, or mousse to a selected location.

A preferred embodiment of the dispenser has an elongated cylindrical transparent glass container having a bottom wall, an open top, and a chamber for storing a propellant and material such as a liquid. A cap mounted on the container closes the open top and supports a normally closed control valve having an upwardly directed tubular stem. The container has an actuator member that is mounted on the outer end of the stem. The actuator has an upwardly directed tubular spout that is closed with a removable cap member. The cap member is removed from the actuator member so that when the stem is moved relative to a seal to open the valve, the propellant and the material is dispensed from the container as a foam, spray, or mousse or jet through the spout of the actuator member.

An elongated frangible ampule is located within the chamber for storing a second material separate and isolated from the first material. A rigid ampule holder having a sleeve with a passage that accommodates the upper end of the ampule supports the ampule in a generally diagonal position in the chamber. Holder has a cylindrical shoulder that telescopes into the mouth of the container to facilitate automatic assembly of the holder on the container. In a modification of the dispenser of the invention, a downwardly directed bracket is attached to the holder to accommodate the lower portion of the ampule. The bracket has a pair of convex curved arms that grip the ampule to hold it in the diagonal position. This diagonal position is generally parallel to the diagonal dimension or length of the chamber. The diagonal location of the ampule in the chamber allows a relatively large ampule to be stored within the chamber. This allows the dispenser to have a large range of ratios of the first and second materials. The second material in the ampule being separated and isolated from the first material in the container increases the shelf life of the product and minimizes the deterioration of the gasket and seal structures of the control valve. The holder has open upper and lower ends. The upper end of the holder has a cylindrical should and an outwardly directed flange that engages the top of the container to mount the holder on the container. A push rod connected to the moveable member extends downwardly adjacent the passage of the sleeve and the ampule. A generally cylindrical filter mounted on the lower portion of the valve housing supports and guides the push rod. The push rod has a downwardly directed conical shaped finger that is located in engagement with the inside surface of the holder adjacent the ampule when the control valve is in a closed position. The finger cooperates with the inclined side wall of the holder to force the rod into the side of the ampule to break the ampule when the stem is moved down or depressed. The second material in the ampule flows into the chamber where it is mixed with the first material and propellant. A plurality of vent holes provided in the upper portion of the holder facilitates the mixing of the materials. The mixed materials and propellant move through the vent holes and the open bottom of the holder and through the filter and into the valve when the valve is opened thereby allowing the mixed materials to be dispensed as a spray, foam, or mousse to a desired location. The filter prevents particulates from entering the valve and being dispensed from the dispenser. A protective cover is mounted on the actuator member to prevent accidental dispensing of materials and premature rupture of the ampule.

The objects and advantages of the dispenser of the invention are embodied in the dispenser structure and functions as shown in the drawing and described in the specification of the preferred embodiments thereof.

DESCRIPTION OF PREFERRED EMBODIMENTS

Figure 1:
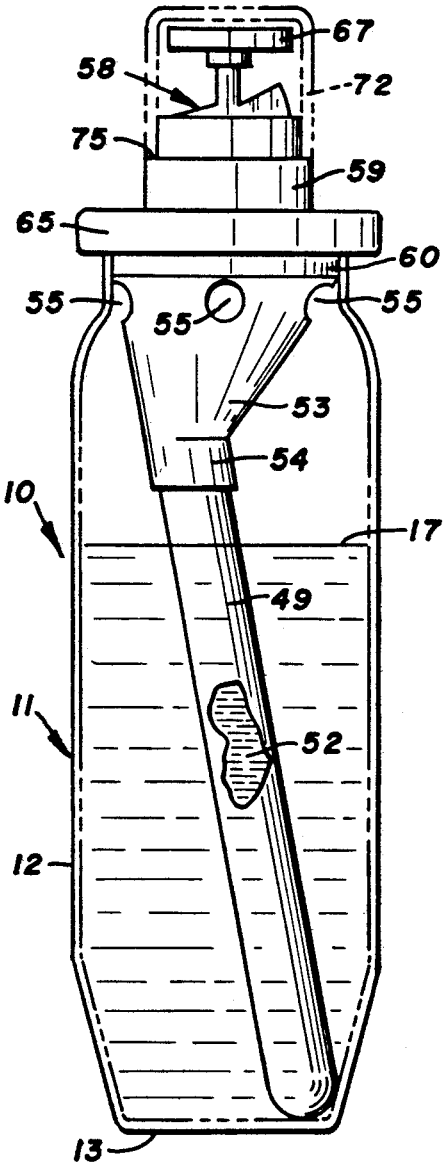
FIG. 1 is a side elevational view of the dispenser of the invention.
Figure 2:
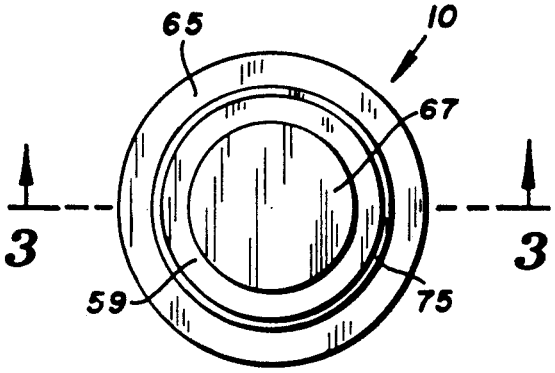
FIG. 2 is an enlarged top view of FIG. 1.
Figure 3:
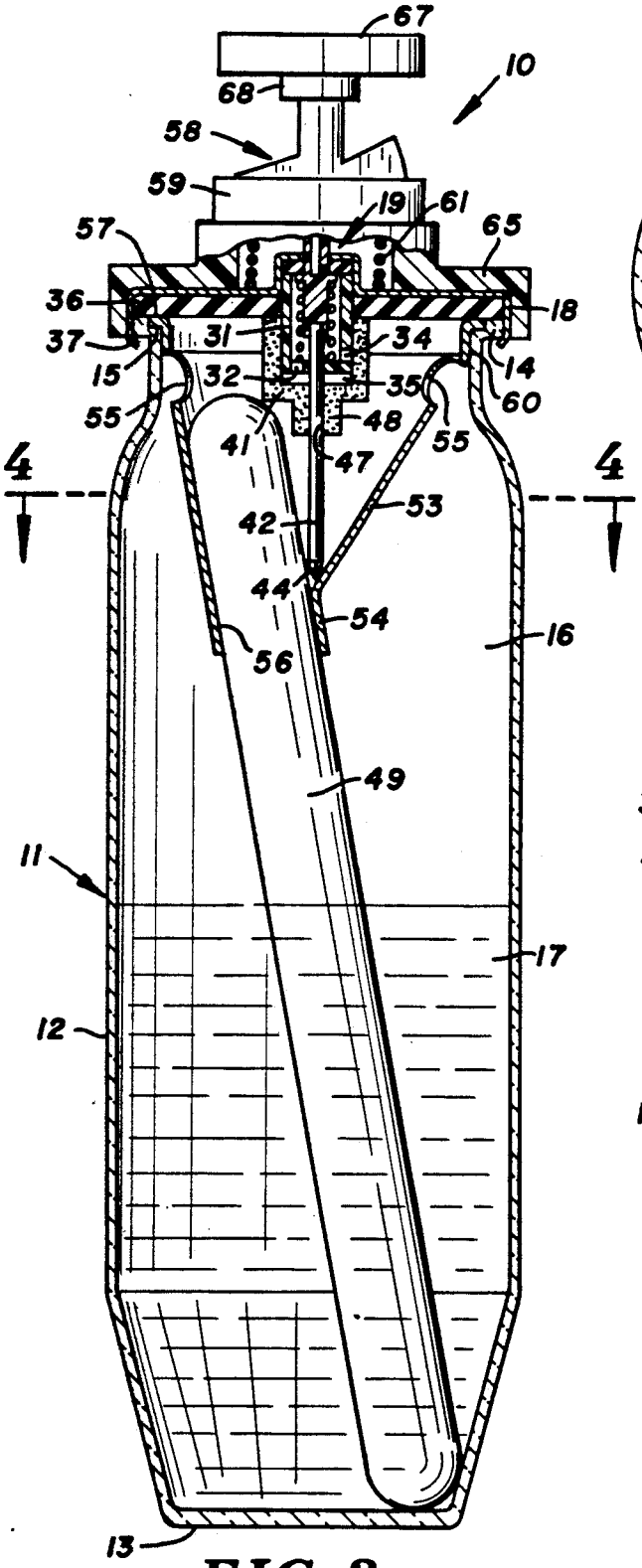
FIG. 3 is an enlarged sectional view taken along the line 3—3 of FIG. 2.

Referring to FIGS. 1, 2, and 3, there is shown the dispenser 10 of the invention for delivering mixed materials with a propellant to a desired location. The materials within dispenser 10 are mixed immediately prior to use so that the effectiveness of the materials is not reduced. Dispenser 10 and the separate materials therein have substantial shelf life since there is little or no reaction within the container prior to the mixing of the materials within the container. Dispenser 10 can be used with two component materials such as epoxies, two component adhesives, human hair permanents, hair relaxers, hair dyes, hair sunscreens, hair stylers and shampoos hereinafter described.

Dispenser 10 has an external bottle or container 11 made out of rigid material, such as glass, plastic, metal or the like. The material maybe transparent to allow visual inspection of the interior of bottle 11. Bottle 11 has a cylindrical side wall 12 joined to a generally flat bottom wall 13. The top of side wall 12 has an annular rim or bead 14 surrounding an opening or mouth into chamber 16 of container 11. A material 17, such as a liquid, is normally stored in chamber 16 along with a propellant which maintains material 17 under pressure within chamber 16. Common Freons and hydrocarbon propellants are suitable propellant materials. Side wall 12 of container 11 has sufficient structural strength to accommodate the pressure of the propellant in chamber 16. The open top of container 11 is closed with a cap 18 that supports a normally closed control valve indicated generally at 19.

Figure 5:
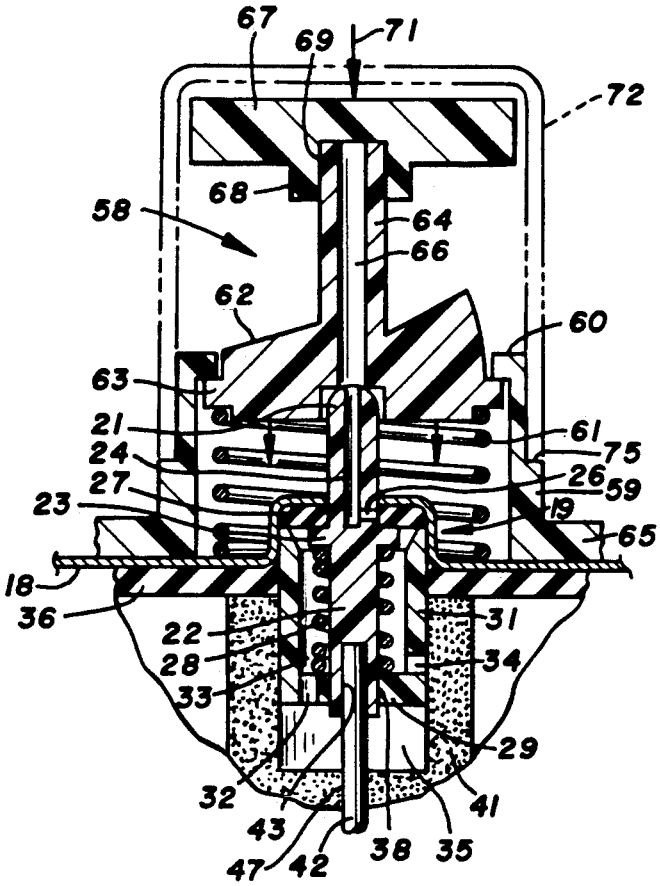
FIG. 5 is an enlarged longitudinal sectional view similar to FIG. 3 showing the nozzle and valve assemblies of the dispenser.

As shown in FIG. 5, control valve 19 has a generally upright tubular stem 21 that projects upwardly from cap 18. The lower portion of stem 21 has an elongated body 22 having an outwardly directed annular flange 23. Stem 21 has a passage 24 open to the top to the stem and open to an upper side port 26 that allows the propellant and the material to flow into passage 24. An annular diaphragm 27 surrounding stem 21 is normally aligned with upper side port 26 to maintain valve 19 in a closed position. A coil spring 28 engages flange 23 to hold stem 21 in an up or closed position. The lower or inner end of coil spring 28 bears against the bottom wall 29 of a generally cup-shaped housing 31 that surrounds body 22. Housing 31 has a lower port 32 and a lower side port 34 that are in communication with an internal or upper chamber 33 allowing the propellant and material to flow into chamber 33 and to upper side port 26 when control valve 19 is in the open position. Spring 28 biases stem 21 in a closed position as shown in FIG. 5.

Returning to FIG. 3, a tubular filter 41 surrounds the lower end of housing 31. Filter 41 has a cylindrical inside wall positioned in tight fit relation around housing 31 to retain filter 41 on housing 31. The upper end of filter 41 bears against a gasket 36 clamped on bead 14 with cap 18. Propellant and the material flow through filter 41 into bottom chamber 35 before entering port 32 of valve housing 31. The material and propellant also enter port 34 after flowing through filter 41. The filter 41 prevents particulates, such as glass particles and the like, from flowing into valve 19 and being dispensed from the dispenser. Filter 41 is a porous polyethylene generally cylindrical member. Other types of materials can be used for filter 41. The pore size of filter 41 is in the range of 45 to 75 microns. The bottom of filter 41 has a cylindrical shaped boss 48 having a smaller diameter than the diameter of the top portion to the filter. Other types of filters can be used to prevent foreign particles from interfering with the operation of control valve 19.

Annular gasket 36 of compressible material surrounds housing 31 and bears against the top of bead 14 of container 11. Cap 18 has a clamp ring 37 that is turned about or clamped over gasket 36 and bead 14 to seal cap 18 on container 11.

Referring to FIGS. 3 and 5, the lower portion of body 22 has a hole or recess 43 accommodating a downwardly directed compression or push rod 42 in tight fit relation. Push rod 42 is an elongated rigid member having a smooth outer cylindrical surface slidably retained on housing 31 so that rod 42 can move with stem 21. Rod 42 is a metal rod having a continuous and smooth cylindrical outer surface. Other types of rigid materials can be used to make rod 42. The upper end of rod 42 fits into recess 43 and extends through a hole 38 in the bottom of housing 31. Rod 42 extends downwardly through a hole 47 in boss 48 of filter 41. Rod 42 has a close sliding fit relation with boss 48 to prevent foreign particles from entering port 32. Filter 41 and housing 31 support and guide push rod 42. Spring 28 also serves as a stop to limit the depression or inward movement of stem 21. Body 22 has a diameter that is smaller than the diameter of chamber 33 so that the propellant and material can freely flow to upper side port 26 when port 26 is moved below diaphragm 27 to allow the material to flow through the valve 19 and nozzle 58 and be dispensed to a desired location.

Figure 4:
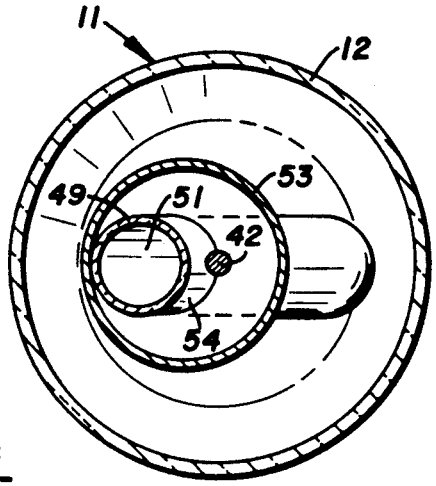
FIG. 4 is a sectional view taken along line 4—4 of FIG. 3.
Figure 6:
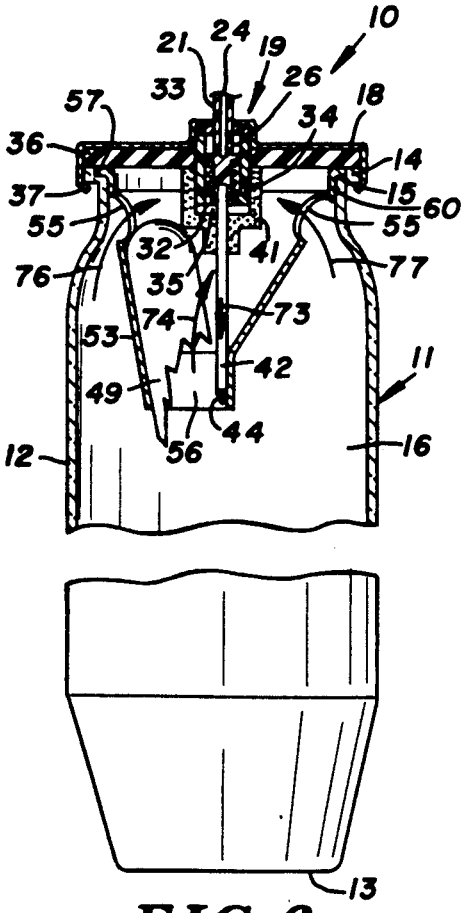
FIG. 6 is a foreshortened sectional view similar to FIG. 3 showing the breaking of the ampule.

As shown in FIGS. 3, 4 and 6, the bottom of push rod 42 has a downwardly directed conical shaped finger 44 having a pointed lower end. Other shapes can be used for finger 44. Finger 44 extends downwardly generally parallel to the longitudinal axis of rod 42. Finger 44 is located contiguous to the inner surface of the side wall of a holder 53 when control valve 19 is in its closed position.

An elongated cylindrical frangible ampule or vial 49 having a sealed chamber 51 storing a second material 52 such as liquid, chemical, powders, and the like, that is desired to be mixed with material 17 in chamber 16 immediately prior to use of the dispenser is located in chamber 16. Ampule 49 is made of breakable material, such as a glass vessel located generally along the diagonal length of chamber 16. This position of ampule 49 allows a relatively large ampule to be located within chamber 16 so that a wide range of ratios of amounts of materials can be mixed in chamber 16. The diameter of ampule 49 is smaller than the diameter of the opening into chamber 16 to allow it to be placed in chamber 16. The length of ampule 49 can be substantially the same as the diagonal length of chamber 16. The size of ampule 49 is selected to provide the desired ratio of volumes of material 17 to material 52.

The location of the ampule 49 in the container does not depend upon the height of the container 11. The ampule 49 is always held the same distance from the valve and cap regardless of the height of the container 11.

Figure 16:
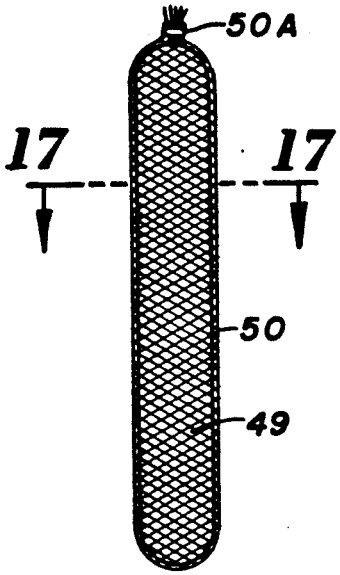
FIG. 16 is an elevational view of an ampule enclosed within a mesh bag.
Figure 17:
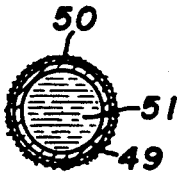
FIG. 17 is an enlarged sectional view taken along line 17—77 of FIG. 16.

As shown in FIGS. 16 and 17, ampule 49 is encased within a mesh bag or pouch 50. The open end of bag 50 is closed with cords 50A or other suitable closure structure.

Bag 50 is a fine mesh plastic fabric that retains the broken glass of the ampule. The material 51 within ampule 49 flows through bag 50 after the ampule 49 is broken and mixes with the material 16 within container 11. Bag 50 also protects ampule 49 during handling and storage.

Ampule 49 is retained in its generally diagonal position with a conical holding member or holder 53. Holder 53 rests on the top of container 11 and accommodates an upper end of ampule 49. The lower end of ampule 49 rests on bottom wall 13 of container 11. Holder 53 is a one-piece generally conical member having a cylindrical shoulder 55 joined to an inwardly tapered side wall that extends downwardly into chamber 16. As seen in FIG. 3, the top end of holder 53 has an outwardly directed annular flange 57. The diameter of the top end of funnel 53 is substantially the same as the diameter of the opening into chamber 16 whereby flange 57 extends outwardly into an annular groove 15 in bead 14 to mount holder 53 on the top of container 11. Cylindrical shoulder 60 telescopes into the open end of container 11 as shown in FIGS. 3 and 6. Shoulder 60 is in close fit relation to the inside wall of the open end of container 11 to firmly mount the holder 53 on container 11. The shape of holder 53 and shoulder 60 permit automatic machine assembly of the holder 53 on container 11. The conical member of holder 53 is shaped so that finger 44 of rod 42 engages the conical member along the central longitudinal axis of container 11 so that rotational alignment of the holder 53 on the container 11 is not required during assembly of the holder on the container. Flange 57 engages the lower surface of gasket 36. Clamp ring 37 of cap 18 is clamped over bead 14 to retain funnel 53 on container 11. The lower end of holder 53 has a cylindrical sleeve 54 having a passage 56 that accommodates the upper end of ampule 49. Passage 56 has a diameter substantially the same as the diameter of ampule 49 whereby the ampule has a sliding light fit relation with sleeve 54 to retain holder 53 on ampule 49. The longitudinal axis of sleeve 54 extends generally parallel to the diagonal axis of chamber 16 to hold ampule 49 in its diagonal position. The upper end of holder 53 has a plurality of vent holes 55 and an open bottom end so that material is not trapped in the holder. Finger 44 is located contiguous to the inside surface of the side wall of holder 53 adjacent sleeve 54 and the side wall of ampule 49 when valve 19 is in the closed position. Ampule 49 is not broken so that material 52 therein is isolated from material 17 in chamber 16. The structural condition of ampule 49 and contents of container 11 can be visually observed through the transparent side wall 12 of container 11.

Referring to FIGS. 3 and 5, a nozzle, indicated generally at 58, is mounted on the outer end of stem 21 with housing 59. The lower end of housing 59 has an outwardly directed annular flange 65 that is mounted on cap 18. The outer end of flange 65 extends downwardly adjacent the outer side surface of cap 18 in tight fit relation to retain nozzle 58 on cap 18 as see in FIG. 3. The top end of housing 59 has an inwardly directed annular lip 60. Nozzle 58 is biased upwardly into engagement with lip 60 with a coil spring 61. Spring 61 is supported on cap 18 and surrounds valve 19.

Nozzle 58 has a body 62 having an outwardly directed flange 63 under lip 60 which allows nozzle 58 to be pressed toward container 11 to open valve 19. Lip 60 is a stop preventing outward movement and separation of nozzle 58 from housing 59. A tubular spout or nipple 64 having a passage 66 is joined to the top of nozzle body 62. Spout 64 is used to direct materials to a desired location.

A cap or button 67 is mounted on the outer end of spout 64 to prevent materials from moving through passages 24 and 66 during the opening of valve 19 and the breaking of the ampule 49 and mixing of materials in chamber 16. Button 67 has a sleeve 68 with a blind hole 69 accommodating spout 64. Hole 69 has a size about the same as the end of spout 64 whereby spout 64 has a releasable light fit with sleeve 68 to close passage 66. Other types of cap members can be used to close passage 66. A force indicated by arrow 71 in FIG. 5 is applied to button 67 to move nozzle 58 axially into housing 59 causing stem 21 to move in a downward direction. This moves valve 19 to the open position and push rod 42 in a downward direction. Button 67 prevents the materials and propellant under pressure in chamber 16 from being discharged from stem 21 and nozzle 58. Finger 44 of push rod 42 is guided downwardly by the side wall of holder 53 into tight engagement with the side of ampule 49. Continued downward movement of push rod 42, as indicated by arrow 73 in FIG. 6, continues to exert downward force on the ampule 49 and wedges finger 44 between the top of sleeve 54 and ampule 49. This force of push rod 42 against ampule 49 fractures or breaks ampule 49 thereby releasing material 52 into chamber 16 where it is mixed with material 17. The mixing of materials can be facilitated by shaking dispenser 10. The materials are free to flow through vent holes 55 and the open bottom of holder 53. This allows materials in holder 53 to be thoroughly mixed with all of the material in chamber 16. As soon as ampule 49 is broken, the external force 71 on button 67 can be removed. Springs 61 and 28 will then move nozzle 58 and stem 21 to their closed positions, respectively, as shown in FIG. 5. Button 67 is then removed from spout 64 to allow use of dispenser 10 to discharge the mixed materials and propellant as a foam, spray, mousse or jet to desired locations when valve 19 is open. Other types of actuator members and discharge nozzles can be used with stem 21 to open control valve 19 and direct aerosol foam spray to desired locations.

Dispenser 10 is stored and transported in the manner shown in FIG. 1. A cup-shaped protective cover 72 can be placed over button 67 and nozzle 58 and fitted on housing 59. Housing 59 has an outwardly directed shoulder 75 for accommodating the lower end of cover 72. The inner side surface of cover 72 engages the outer surface of housing 59 in tight fit relation to hold cover 72 on housing 59. Cover 72 snaps on housing 59 when a downward force is applied to the top of the cover. Control valve 19 is closed thereby confining material 17 and propellant under pressure to chamber 16. Ampule 49 being a hermetically sealed vessel, separates and isolates material 52 from material 17 and propellant in chamber 16. This substantially increases the shelf life of materials 17 and 52 and minimizes deterioration of the seal materials of control valve 19. The separation of the first and second materials also allows the dispenser to use hair care products, such as hair permanents, hair relaxers, and hair dye.

Holder 53 and sealed ampule 49 containing material 52 are placed in chamber 16 through the top opening before cap 18 is attached to rim 14. The cylindrical shoulder 60 telescopes into container 11 and annular flange 57 of holder 5 is located in groove 15 of rim 14 to mount holder 53 on container 11. Cap 18 and control valve 19 are placed on top of container as a unit. Push rod 42 extends downwardly into chamber 16 to locate finger 44 contiguous to the inner surface of the side wall of funnel 53 adjacent the side of ampule 49. Material 17 can be placed in chamber 16 before cap 18 is placed on container 11. Propellant can be introduced into chamber 16 through stem 21 by opening valve 19 without breaking ampule 49. Propellant can enter chamber 16 through vent holes 55. The entire assembly can be an automatic machine operation.

In use, the operator removes cover 72 from housing 59 and applies force 71 on button 67 to move stem 21 down into container 11. This opens control valve 19 and moves push rod 42 down into engagement with ampule 49. Button 67 prevents material and propellant under pressure in chamber 16 from being discharged from spout 64. Finger 44 is forced downwardly into the side wall of ampule 49 to break ampule 49, as shown in FIG. 6. Material 52 in ampule 49 mixes with material 17. Vent holes 55 and the open bottom of holder 53 allow the materials 17 and 52 to mix thoroughly. Button 67 is removed from spout 64. Dispenser 10 is now ready for use to dispense a foam, spray or jet of mixed materials and propellant to a desired location.

Figure 7:
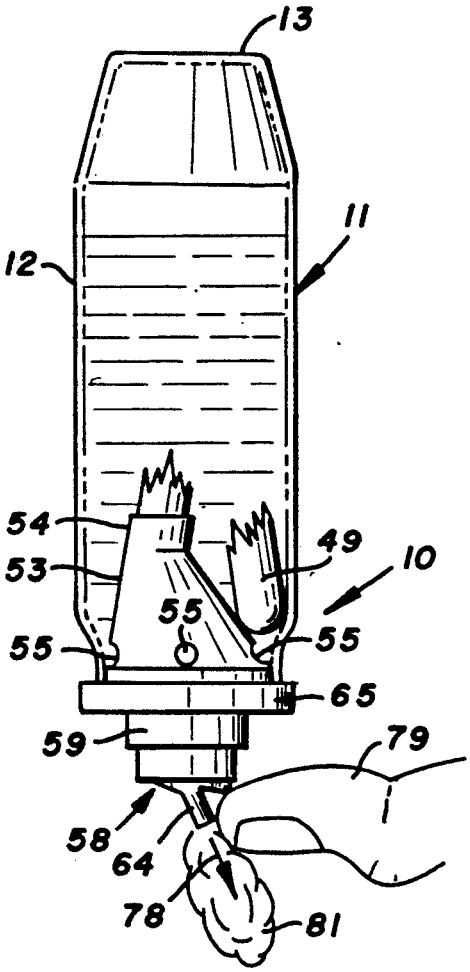
FIG. 7 is a side view showing use of the dispenser of FIG. 1.

To dispense a foam or mousse of mixed materials and propellant the operator inverts dispenser 10, as shown in FIG. 7, and directs spout 64 of nozzle 58 toward an area of desired application. Filter 41 prevents the glass particles of broken ampule 49 from entering valve 19. Thumb 79 of the operator is used to apply a force on nozzle 58. This causes nozzle 58 to move axially into housing 59 thereby moving stem 21 into the container 11. This opens control valve 19 allowing the mixed materials and propellant to flow from chamber 16 through the open bottom of funnel 53, as indicated by arrow 74 in FIG. 6, and vent holes 55, as indicated by arrows 76 and 77 in FIG. 6. The mixed materials and propellant pass through filter 41 and enter housing chamber 33 through lower port 32 and lower side port 34. The materials and propellant then flow through upper side port 26 and into passages 24 and 66 and are discharged from spout 64 as a spray, mousse, jet or foam 81 in an outward direction, as indicated by arrow 78 in FIG. 7, to the area of desired application, such as the hair of a person.

Referring to FIGS. 8 to 15, there is shown a modification of the dispenser 100 of the invention for delivering mixed materials with a propellant to a desired location. The parts of dispenser 100 that correspond to parts of dispenser 10 have the same reference numbers with the prefix 1. The materials within dispenser 100 are mixed immediately prior to use so that the effectiveness of the materials is not reduced. Dispenser 100 and the separate materials therein have substantial shelf life since there is little or no reaction within the container prior to the mixing of the materials within the container. Dispenser 100 canbe used with materials such as hair permanents, hair relaxers, hair dyes, hair sunscreens, hair stylers and shampoos hereinafter described.

Dispenser 100 has an external bottle or container 111 made out of rigid material, such as glass, plastic, metal or the like. The material of bottle 111 can be transparent to allow visual inspection of the interior of bottle 111. Bottle 111 has a cylindrical side wall 112 joined to a generally flat bottom wall 113. The top of side wall 112 has an annular rim or bead 114 surrounding an opening or mouth into chamber 116 of container 111. A material 117, such as a liquid, is normally stored in chamber 116 along with a propellant which maintains material 117 under pressure within chamber 116. Side wall 112 of container 111 has sufficient structural strength to accommodate the pressure of the propellant in chamber 116. The open top of container 111 is closed with a cap 118 that supports a normally closed control valve indicated generally at 119.

Figure 10:
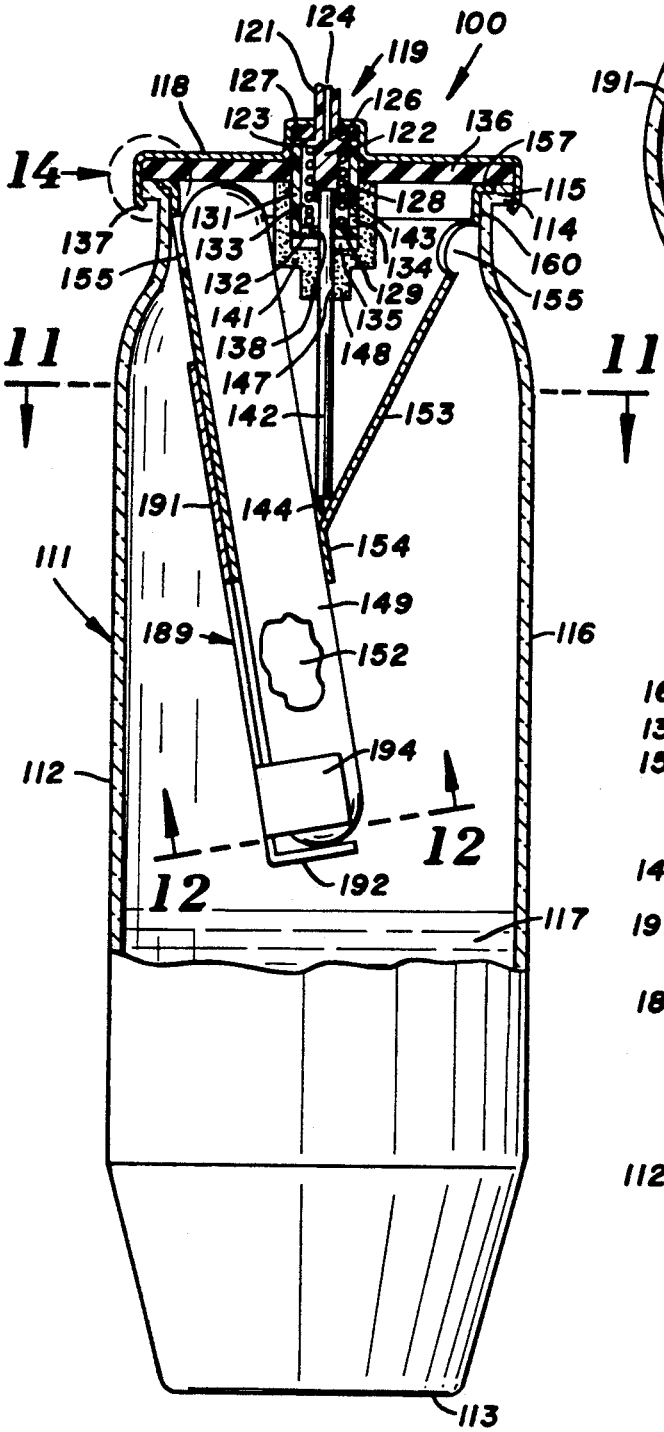
FIG. 10 is an enlarged sectional view taken along line 10—10 of FIG. 9.

As shown in FIG. 10, control valve 119 has a generally upright tubular stem 121 that projects upwardly from cap 118. The lower portion of stem 121 has an elongated body 122 having an outwardly directed annular flange 123. Stem 121 has a passage 124 open to the top to the stem and open to an upper side port 126 that allows the propellant and the material to flow into passage 124 and the passage of a nozzle 158. An annular diaphragm 127 surrounding stem 121 is normally aligned with upper side port 126 to maintain valve 119 in a closed position. A coil spring 128 engages flange 123 to hold stem 121 in an up or closed position. The lower or inner end of coil spring 128 bears against the bottom wall 129 of a generally cup-shaped housing 131 that surrounds body 122. Housing 131 has a lower port 132 and a lower side port 134 that are in communication with an internal or upper chamber 133 allowing the propellant and material to flow into chamber 133 and to upper side port 126 when control valve 119 is in the open position. Spring 128 biases stem 121 in a closed position as shown in FIG. 10. A tubular filter 141 surrounds the lower end of housing 131. Filter 141 has a cylindrical inside wall positioned in tight fit relation around housing 131 to retain filter 141 on housing 131. The upper end of filter 141 bears against a gasket 136 clamped on bead 141 with cap 118. Propellant and the material flow through filter 141 into bottom chamber 135 before entering port 132 of valve housing 131. Propellant and material also enter port 134 after flowing through filter 141. The filter 141 prevents particulates, such as glass particles and the like, from flowing into control valve 119 and being dispensed from the dispenser. Filter 141 is a porous polyethylene generally cylindrical member. Other types of materials can be used for filter 141. The pore size of filter 141 is in the range of 45 to 75 microns. The bottom of filter 141 has a cylindrical shaped boss 148 having a smaller diameter than the diameter of the top portion to the filter. Other types of filters can be used to prevent foreign particles from interfering with the operation of control valve 119. Annular gasket 136 of compressible material surrounds housing 131 and bears against the top of flange 157 of funnel 153. Cap 118 has a clamp ring 137 that is turned about or clamped over gasket 136, flange 157, and bead 114 to seal cap 118 on container 111.

The lower portion of body 122 has a hole or recess 143 accommodating a downwardly directed compression or push rod 142 in tight fit relation. Push rod 142 is an elongated rigid member having a smooth outer cylindrical surface slidably retained on housing 131 so that rod 142 can move with stem 121. Rod 142 is a metal rod having a continuous and smooth cylindrical outer surface. Other types of rigid materials can be used to make rod 142. The upper end of rod 142 fits into recess 143 and extends through a hole 138 in the bottom of housing 131. Rod 142 extends downwardly through a hole 147 in boss 148 of filter 141. Rod 142 has a close sliding fit relation with boss 148 to prevent foreign particles from entering port 132. Filter 141 and housing 131 support and guide push rod 142. Spring 128 also serves as a stop to limit the depression or inward movement of stem 121. Body 122 has a diameter that is smaller than the diameter of chamber 133 so that the propellant and material can freely flow to upper side port 126 when port 126 is moved below diaphragm 127 to allow the material to flow through the valve 119 and nozzle 158 and be dispensed to a desired location.

Figure 11:
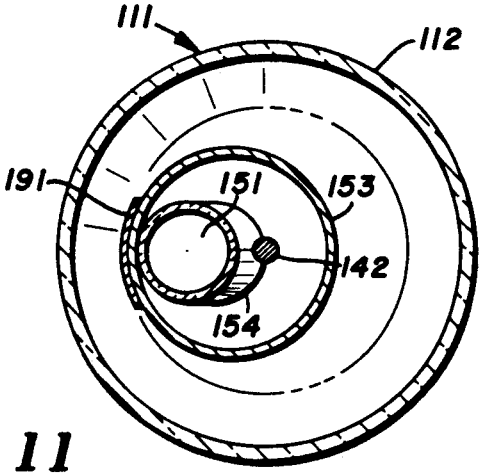
FIG. 11 is a sectional view taken along 11—11 of FIG. 10.
Figure 13:
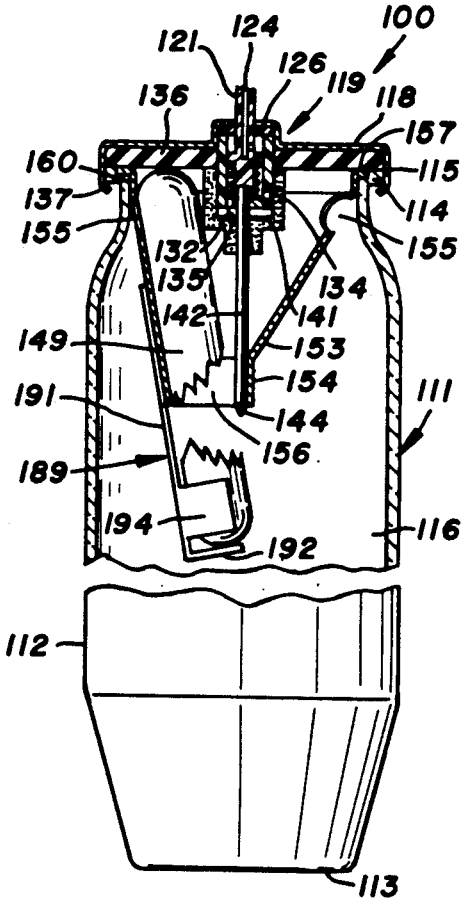
FIG. 13 is a foreshortened sectional view similar to FIG. 10 showing the breaking of the ampule.
Figure 8:
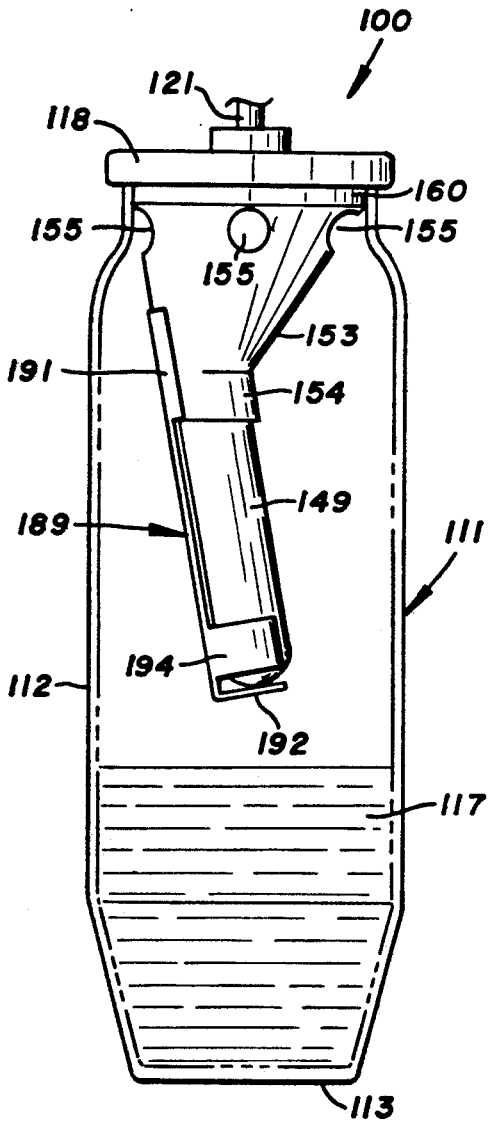
FIG. 8 is a side elevational view of a modification of the dispenser of the invention.
Figure 9:
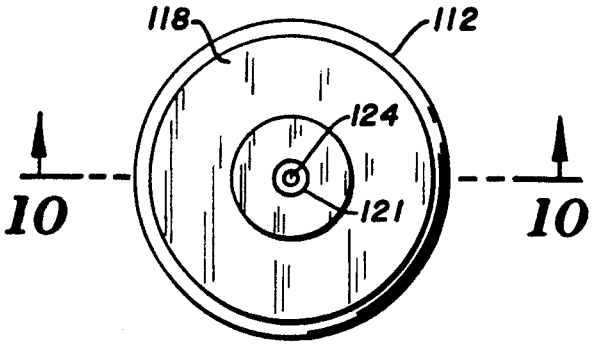
FIG. 9 is a top view of FIG. 8.

As shown in FIGS. 10, 11, and 13, the bottom of push rod 142 has a downwardly directed conical shaped finger 144 having a pointed lower end. Other shapes can be used for finger 144. Finger 144 extends downwardly generally parallel to the longitudinal axis of rod 142. Finger 144 is located contiguous to the inner surface of the side wall of a holder 153 when control valve 119 is in its closed position.

An elongated cylindrical frangible ampule or vial 149 having a sealed chamber 151 storing a second material 152, such as liquid, chemical, powders, and the like, that is desired to be mixed with material 117 in chamber 116 immediately prior to use of the dispenser is located in chamber 116. Ampule 149 is made of breakable material, such as a glass vessel located generally along the diagonal axis of chamber 116. This position of ampule 149 allows a relatively large ampule to be located within chamber 116 so that a wide range of ratios of amounts of materials can be mixed in chamber 116. The diameter of ampule 149 is smaller than the diameter of the opening into chamber 116 to allow it to be placed in chamber 116. The length of ampule 149 is less than the diagonal length of chamber 116. The size of ampule 149 is selected to provide the desired ratio of volumes of material 117 to material 152.

Figure 14:
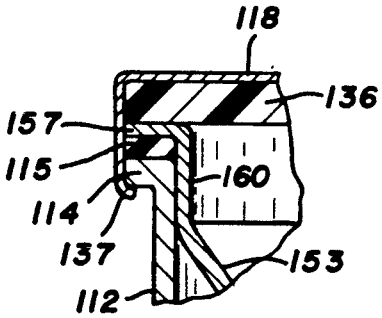
FIG. 14 is an enlarged sectional view of a portion of the cap and seal attached to the top of the container.

Ampule 149 is retained in its generally diagonal position with a conical holding member or holder 153. Holder 153 rests on the top of container 111 and accommodates an upper end of ampule 149. The lower end of ampule 149 rests on a base 192 of a bracket member 189. Holder 153 is a one-piece generally conical member having a cylindrical shoulder 160 and an inwardly tapered side wall that extends downwardly into chamber 116. As seen in FIG. 14, the top end of holder 153 has an outwardly directed annular flange 157. The diameter of the top end of holder 153 is substantially the same as the diameter of the opening into chamber 116 whereby flange 157 extends outwardly adjacent the outer end of bead 114 to mount holder 153 on the top of container 111. Annular seal 115 of compressible material surrounds holder 153 and bears against the top of bead 114 and the bottom of flange 157. Clamp ring 137 of cap 118 is clamped over bead 114 to seal holder 153 on container 111. The lower end of holder 153 has a cylindrical sleeve 154 having a passage 156 that accommodates the upper end of ampule 149. Passage 156 has a diameter substantially the same as the diameter of ampule 149 whereby the ampule has a sliding light fit relation with sleeve 154 to retain holder 153 on ampule 149. The longitudinal axis of sleeve 154 extends generally parallel to the diagonal axis of chamber 116 to hold ampule 149 in its diagonal position. The upper end of holder 153 has a plurality of vent holes 155 and an open bottom end so that material is not trapped in the holder. Finger 144 is located contiguous to the inside surface of the side wall of holder 153 adjacent sleeve 154 and the side wall of ampule 149 when valve 119 is in the closed position. Ampule 149 is not broken so that material 152 therein is isolated from material 117 in chamber 116. The structural condition of ampule 149 and contents of container 111 can be visually observed through the transparent side wall 112 of container 111.

Figure 12:
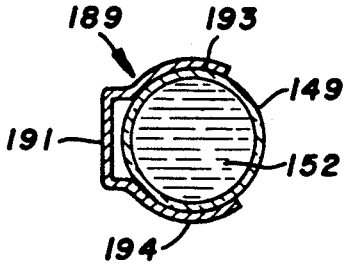
FIG. 12 is a sectional view taken along 12—12 of FIG. 10.

An elongated downwardly directed bracket, indicated generally at 189, is attached to the lower end of holder 153 for accommodating the lower end of ampule 149. Bracket 189 has a generally linear body 191 having a convex curved upper section adapted to be secured to the side wall of holder 153 as seen in FIG. 11. Body 191 has a flat lower section that extends downwardly from the lower end of sleeve 154 generally parallel to the longitudinal axis of sleeve 154 and the diagonal axis of chamber 116. The lower end of body 191 has a base 192 extending normal to the longitudinal axis of bracket 189 for supporting the lower end of ampule 149. As shown in FIG. 12, bracket 189 has a pair of convex curved arms 193 and 194 projecting outwardly from body 191 adjacent base 191 that grip the lower end section of ampule 149. Bracket 189 and holder 153 cooperate to hold the ampule 149 in its diagonal position in chamber 116. The length of bracket 189 is less than the diagonal length of chamber 116 so as to retain the upper end of ampule 149 in passage 156 of sleeve 154. Ampule 149 can extend upwardly to cap 118. The length of bracket 189 can be selected to hold different sized ampules to provide the desired ratio of volumes of material 117 to material 152. For example, bracket 189 can be constructed so that the base 192 is located adjacent bottom wall 113 of container 111 whereby the length of ampule 149 can be substantially the same as the diagonal length of chamber 116.

Figure 15:
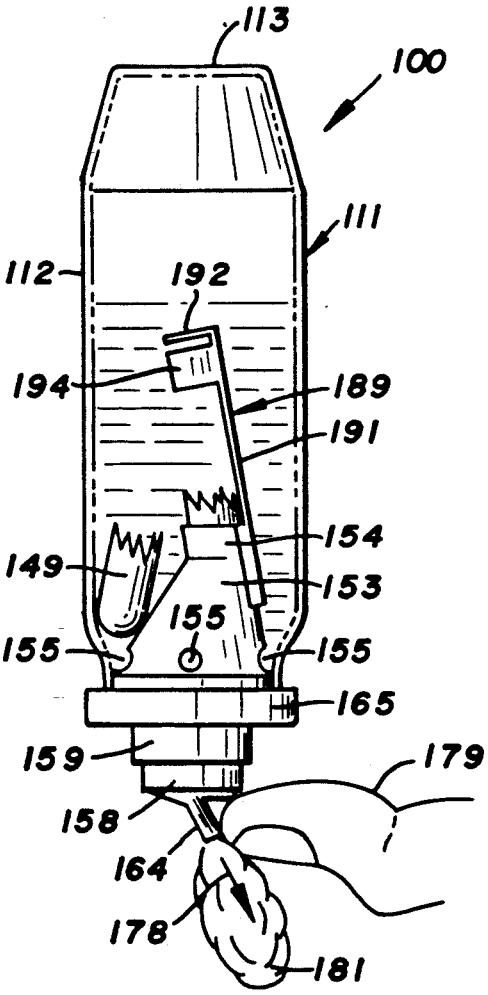
FIG. 15 is a side view showing use of the dispenser of FIG. 8.

As shown in FIG. 15, a nozzle 158 is mounted on the outer end of stem 121 with housing 159. The lower end of housing 159 has an outwardly directed annular flange 165 that is mounted on cap 118 in tight fit relation to retain nozzle 158 on cap 118. Nozzle 158 is adapted to be pressed toward container 111 to open valve 119. A tubular spout or nipple 164 is joined to the top of nozzle 158. Spout 164 is used to direct materials to a desired location.

A button (not shown) can be mounted on the outer end of spout 164 to prevent materials from moving through passage 124 and the passage of spout 164 during the opening of valve 119 and the breaking of the ampule 149 and mixing of materials in chamber 116. A downward force is applied to the button to move nozzle 158 axially into housing 159 causing stem 121 to move in a downward direction. This moves valve 119 to the open position and push rod 142 in a downward direction. The button prevents the materials and propellant under pressure in chamber 116 from being discharged from stem 121 and nozzle 158. Finger 144 of push rod 142 is guided downwardly by the side wall of holder 153 into tight engagement with the side of ampule 149. Continued downward movement of push rod 142 continues to exert downward force on the ampule 149 and wedges finger 144 between the top of sleeve 154 and ampule 149. This force of push rod 142 against ampule 149 fractures or breaks ampule 149 thereby releasing material 152 into chamber 116 where it is mixed with material 117. The mixing of the materials 117 and 152 can be facilitated by shaking dispenser 100. The materials are free to flow through vent holes 155 and the open bottom of holder 153. This allows materials in holder 153 to be thoroughly mixed with all of the material in chamber 116. As soon as ampule 149 is broken, the external force on the button can be removed. Spring 128 will then move stem 121 to its closed position as shown in FIG. 10. The button is then removed from spout 164 to allow use of dispenser 100 to discharge the mixed materials and propellant as a foam, spray, mousse, or jet to desired locations when valve 119 is open.

Dispenser 100 is stored and transported in the manner shown in FIG. 1. A cup-shaped protective cover (not shown) can be placed over the button and nozzle 158 and fitted on housing 159. Housing 159 has an outwardly directed shoulder for accommodating the lower end of the cover. The inner surface of the cover engages the outer surface of housing 159 in a tight fit relation to hold the cover on housing 159. The cover snaps on housing 159 when a downward force is applied to the top of the cover. Control valve 119 is closed thereby confining material 117 and propellant under pressure to chamber 116. Ampule 149 being a hermetically sealed vessel, separates and isolates material 152 from material 117 and propellant in chamber 116. This substantially increases the shelf life of materials 117 and 152 and minimizes deterioration of the seal materials of control valve 119. The separation of the first and second materials also allows the dispenser to use hair care products, such as hair permanents, hair relaxers, and hair dye.

Holder 153, bracket 189, and sealed ampule 149 containing material 152 are placed in chamber 116 through the top opening as a unit before cap 118 is attached to rim 114. The cylindrical shoulder 160 telescopes into container 111 and annular flange 157 of holder 153 is located between gasket 136 and seal 115 to mount holder 160 on container 111. Cap 118 and control valve 119 are placed on top of container 111 as a unit. Push rod 142 extends downwardly into chamber 116 to locate finger 144 contiguous to the inner surface of the side wall of funnel 153 adjacent the side of ampule 149. Material 117 can be placed in chamber before cap 118 is placed on container 111. Propellant can be introduced into chamber 116 through stem 121 by opening valve 119 without breaking ampule 149. Propellant can enter chamber 116 through vent holes 155. The entire assembly can be an automatic machine operation.

In use, the operator applies force on the button to move stem 121 down into container 111. This opens control valve 119 and moves push rod 142 down into engagement with ampule 149. The button prevents material and propellant under pressure in chamber 116 from being discharged from spout 164. Finger 144 is forced downwardly into the side wall of ampule 149 to break ampule 149, as shown in FIG. 13. Material 152 in ampule 149 mixes with material 117. Vent holes 155 and the open bottom of holder 153 allow the materials 117 and 152 to mix thoroughly. The button is removed from spout 164. Dispenser 100 is now ready for use to dispense a foam, spray, mousse or jet of mixed materials and propellant to a desired location.

To dispense a foam of mixed materials and propellant the operator inverts dispenser 100, as shown in FIG. 15, and directs the spout 164 of nozzle 158 toward an area of desired application. Filter 141 prevents the glass particles of broken ampule 149 from entering control valve 119. Thumb 179 of the operator is used to apply a force on nozzle 158. This force causes nozzle 158 to move axially into housing 159 thereby moving stem 121 into the container 111. This opens control valve 119 and allows foam, spray, or the like 181 to be dispensed in an outward direction indicated by arrow 178 to the area of desired application, such as the hair of a person.

Hair care compositions for sunscreens, conditioning and styling can be used with the dispenser of the invention. Two parts of the compositions are separately stored within the container. In use, the two or more parts of compositions are mixed by breaking the ampule. The mixed composition is dispensed as a mousse onto the human hair. Examples of hair care compositions are disclosed in U.S. Pat. Nos 4,526,781; 4,567,038; 4,714,610; and 4,764,363. The disclosures of these patents are incorporated herein by reference.

Compositions for coloring and dyeing human hair are usually prepared in two parts. One part comprising a base ordinarily contains the dyeing or lightening aids and may include one or more oxidation dye intermediates. The second part comprising the oxidizer contains the oxidizing agent and the carrier and may include a stabilizer for the oxidizing agent. The separate parts are hand-mixed prior to use and applied to the hair. The dispenser of the invention is usable to separately store the two parts of human hair and dyeing composition and discharge or eject the mixed composition as a mousse or foam directly onto the human head and hair thereon. Examples of human hair coloring and dyeing compositions are disclosed in the following U.S. Pat. Nos. 3,743,678; 3,811,830; 3,884,627; 3,930,792; 3,950,127; 3,970,423; 3,977,826; 3,981,677; 4,021,486; 4,119,399; 4,196,145; 4,566,876; and 4,776,855. The disclosures of these patents are incorporated herein by reference.

The dispenser of the invention can be used to store, mix, and dispense as a foam or mousse two-part hair relaxer compositions. Examples of hair relaxer compositions are disclosed in U.S. Pat. Nos. 4,303,085; 4,304,244; 4,324,263; 4,373,540; 4,416,296; 4,530,830; and 4,605,018. The compositions disclosed in these patents are incorporated herein by reference.

Shampoos can be dispensed as a foam or mousse with the dispensing apparatus of the invention. The compositions of the shampoos are mixed in the container and subsequently dispensed as a mousse onto a person's hair and/or body. Examples of shampoo compositions are disclosed in U.S. Pat. Nos. 3,959,462; 3,960,782; 3,962,418; 3,990,991; 4,033,895; 4,115,548; 4,195,077; 4,379,753; 4,534,877; and 4,704,272. The compositions disclosed in these patents are incorporated herein by reference.

While there has been shown and described preferred embodiments of the dispenser of the invention, it is understood that changes in the structure, arrangement of structure, and materials may be made by those skilled in the art without departing from the invention. The invention is defined in the following claims.

I claim:

1. A dispenser comprising: a container having a bottom wall, an open top, and a chamber for storing a propellant and first material under pressure, a cap mounted on the container closing said open top, a housing extended into the chamber through said open top, said housing having a passage, control valve means mounted on the cap and housing operable to control the flow of propellant and materials from said passage, said control valve means being normally closed and having a moveable member extended into the passage which can be moved to open said valve means whereby propellant and materials are dispensed from the container, a porous filter mounted on the housing to prevent foreign particles from flowing into the passage whereby when said valve means is open the propellant and materials in said chamber flow through the filter into the passage, frangible ampule means located within said chamber storing a second material separate from the first material until the ampule means is broken, holder means mounted on the container and extended into said chamber having a side wall and a sleeve with a passage accommodating a portion of the ampule means, push rod means connected to the moveable member extended through hole means in the housing and filer adjacent said passage of the sleeve, said side walls of the holder means adapted to engage and guide the push rod means into engagement with the ampule means when the moveable member is first moved to open the valve means thereby breaking the ampule means whereby the second material is mixed with the first material in said chamber.

2. The dispenser of claim 1 wherein: the container includes a transparent side wall whereby the contents of the container and the condition of the frangible ampule means can be visually inspected:

3. The dispenser of claim 1 including: biasing means engageable with the moveable member and housing to bias the valve means to a closed position, said biasing means and housing and filter holding the push rod means adjacent the ampule means.

4. The dispenser of claim 1 wherein: the filter has a bottom wall having a hole, said push rod means extended through said hole and housing with a sliding fit.

5. The dispenser of claim 1 wherein: the container has a annular rim surrounding the open top, and said holder means has a shoulder telescoped into the open top of the container and an outwardly directed annular flange engageable with the rim when the holder means is mounted on the container.

6. The dispenser of claim 1 wherein: said holder means has vent hole means allowing thorough mixing of the first and second materials when the ampule means is broken.

7. A dispenser comprising: a container having a bottom wall, an open top, and a chamber for storing a propellant and first material under pressure, a cap mounted on the container closing said open top, a housing extended into the chamber through said open top, said housing having a passage, control valve means mounted on the cap and housing operable to control the follow of propellant and materials from said passage, said control valve means being normally closed and having a moveable member extended into the passage which can be moved to open said valve means whereby propellant and materials are dispensed from the container, a porous filter mounted on the housing to prevent foreign particles from flowing into the passage whereby when said valve means is open the propellant and materials in said chamber flow through the filter into the passage, frangible ampule means located within said chamber storing a second material separate from the first material until the ampule means is broken, holder means mounted on the container and extended into said chamber having a sleeve with a passage accommodating a portion of the ampule means, push rod means connected to the moveable member extended through the housing and filter adjacent said passage of the sleeve, said holder means adapted to guide the push rod means into engagement with the ampule means when the moveable member is first moved to open the valve means thereby breaking the ampule means whereby the second material is mixed with the first material in said chamber, said holder means having an inwardly and downwardly sloping side wall, the side wall guiding the push rod means downwardly into engagement with the ampule means when the moveable member is moved to open the valve means and move the push rod means thereby breaking the ampule means.

8. The dispenser of claim 7 wherein: the push rod means includes a downwardly directed conical shaped finger located adjacent said ampule means, said finger engaging an inner surface of the side wall of the holder means when the valve means is in a closed position.

9. The dispenser of claim 7 wherein: said moveable member includes a tubular stem projected upwardly from the cap, said stem having a passage for carrying propellant and materials from the valve means when the valve means is open, nozzle means mounted on the stem, said nozzle means having a propellant and materials discharge spout in communication with the passage in the stem for directing propellant and materials to a selected location, and cap means mounted on the nozzle means for preventing propellant and materials from being discharged from the nozzle means during the breaking of the ampule means, said cap means being removable from said nozzle means thereby opening the spout so that propellant and materials can be discharged from the nozzle means when the valve means is open.

10. The dispenser of claim 9 wherein: said cap means has a sleeve with a blind hole, said nozzle means having a portion thereof located within said blind hole.

11. The dispenser of claim 7 including: a downwardly directed bracket member secured to the holder means, said bracket member having a base accommodating a lower end of the ampule means, said base located below the holder means and projecting normal to the longitudinal axis of the bracket member whereby the ampule means is retained in the holder means and said chamber.

12. The dispenser of claim 11 wherein: the bracket member includes a pair of convex curved arms adapted to grip the lower end of the ampule means.

13. A dispenser comprising: a container having an internal chamber for storing a propellant and at least one first component to be dispensed therefrom, normally closed valve means mounted on said container to retain the propellant and component in said chamber, said valve means being moveable to an open position to dispense material to a desired location, filter means mounted on said valve means to prevent foreign particles from entering the valve means, frangible ampule means located within said chamber containing a second component that is separated form the first component within the chamber until said ampule means is broken, means having a side wall holding the ampule in said chamber generally along the length of said chamber, and means mounted on said valve means extended through hole means in the filter engaging said side all of the means for holding the ampule means and engageable with said ampule means to break said ampule means when the valve means is first moved to the open position thereby releasing the second component into said chamber whereby the first and second components are mixed together.

14. The dispenser of claim 13 wherein: said ampule means is a generally cylindrical sealed vial holding a chemical including said second component, said vial having a longitudinal axis generally parallel to the diagonal axis of said chamber.

15. The dispenser of claim 13 wherein: the means for holding the ampule means in said chamber comprises a holder mounted on the container having a sleeve having a passage accommodating an end portion of the ampule means, said sleeve having said side wall and a longitudinal axis generally parallel to the diagonal axis of said chamber.

16. The dispenser of claim 15 wherein: the means extended through the filter engaging said means for holding the ampule means comprises a push rod connected to the valve means, said push rod having a portion guided by the side wall of the holder into engagement with the ampule means on movement of the valve means to the open position to break the ampule means, said push rod supported and guided by the filter.

17. A dispenser comprising: a container having an internal chamber for storing a propellant and at least one first component to be dispensed therefrom, normally closed valve means mounted on said container to retain the propellant and component in said chamber, said valve means being moveable to an open position to dispense material to a desired location, filter means mounted on said valve means to prevent foreign particles from entering the valve means, frangible ampule means located within said chamber containing a second component that is separated from the first component within the chamber until said ampule means is broken, means holding the ampule in said chamber generally along the length of said chamber, and means mounted on said valve means extended through the filter engaging said means for holding the ampule means and engageable with said ampule means to break said ampule means when the valve means is first moved to the open position thereby releasing the second component into said chamber whereby the first and second component are mixed together, said holder has an inwardly and downwardly sloping side all, the side wall guiding the push rod downwardly into engagement with the ampule means when the moveable member is moved to open the valve means and move the push rod means thereby breaking the ampule means.

18. The dispenser of claim 17 wherein: the push rod includes a downwardly directed conical shaped finger located adjacent said ampule means, said finger engaging an inner surface of the side wall of the holder when the valve means is in a closed position.

19. The dispenser of claim 17 including: a bracket member secured to the holder extending downwardly generally parallel to the longitudinal axis of said sleeve, said bracket member having a base accommodating a lower end of the ampule means, said base located below the holder and projecting normal to the longitudinal axis of the bracket member whereby the ampule means is retained in the holder generally along the diagonal length of the chamber.

20. The dispenser of claim 19 wherein: the bracket member includes a pair of convex curved arms adapted to grip the lower end of the ampule means.

21. The dispenser of claim 17 including: means for preventing the dispensing of material when the valve means is first moved to the open position to break the ampule means.

22. The dispenser of claim 21 including: nozzle means having a discharge spout connected to the valve means for receiving propellant and materials and directing propellant and materials to a selected location, said means for preventing the dispensing of material including cap means mounted on the nozzle means for preventing propellant and materials from being discharged from the nozzle means during the breaking of the ampule means, said cap means being removable from said nozzle means thereby allowing propellant and materials to be discharged from the nozzle means when the valve means is open.

23. The dispenser of claim 22 wherein: said cap means has a sleeve with a blind hole, said nozzle means having a portion thereof located within said blind hole.

24. An aerosol foam dispenser comprising: a container having an internal chamber for storing a propellant and a first material, normally closed valve means mounted on said container to retain the propellant and first material in said chamber, said valve means being moveable to an open position to dispense foam to a desired location, at least one frangible ampule means located in the chamber containing a second material separate from the first material, holder means for holding the ampule means in said chamber generally along the length of the chamber, said holder means having an inwardly and downwardly sloping side wall, and push rod means located contiguous to said holder means for holding the ampule means connected to the valve means, said push rod means having a portion engageable with the ampule means and the side wall, said side wall guiding the push rod means downwardly into engagement with the ampule means when the valve means is moved to an open position to break said ampule means thereby releasing the second material into said chamber whereby the first and second material are mixed together.

25. The dispenser of claim 24 wherein: the means for holding the ampule means in said chamber comprises a holder mounted on the container having a sleeve having a passage accommodating an end portion of the ampule means.

26. The dispenser of claim 25 wherein: said holder has vent hole means allowing thorough mixing of the first and second materials when the ampule is broken.

27. The dispenser of claim 25 wherein: said push rod means extended through a filter mounted on the valve means and being supported and guided thereby.

28. The dispenser of claim 24 wherein: the push rod means includes a downwardly directed conical shaped finger located adjacent said ampule means, said finger engaging an inner surface of the side wall of the holder means when the valve means is in a closed position.

29. The dispenser of claim 25 including: a bracket member secured to the holder extending downwardly generally parallel to the longitudinal axis of said sleeve, said bracket member having a base accommodating a lower end of the ampule means, said base located below the holder and projecting normal to the longitudinal axis of the bracket member whereby the ampule means is retained in the holder and said chamber generally along the diagonal length of the chamber.

30. The dispenser of claim 29 wherein: the bracket member includes a pair of convex curved arms adapted to grip the lower end of the ampule means.

31. The dispenser of claim 24 including: means for preventing the dispensing of foam when the valve means is first moved to the open position to break the ampule means.

32. The dispenser of claim 31 including: nozzle means having a discharge spout connected to the valve means for receiving propellant and materials and directing propellant and materials to a selected location, said means for preventing the dispensing of foam including cap means mounted on the nozzle means for preventing propellant and materials from being discharged from the nozzle means during the breaking of the ampule means, said cap means being removable from said nozzle means thereby allowing propellant and materials to be discharged from the nozzle means when the valve means is open.

33. The dispenser of claim 32 wherein: said cap means has a sleeve with a blind hole, said nozzle means having a portion thereof located within said blind hole.

34. A dispenser comprising: a container having a transparent side wall, a bottom wall, an open top, and a chamber for storing a propellant and a first material under pressure, a cap mounted on the container closing said open top whereby the propellant and first material is stored in the chamber under pressure, a housing extended into the chamber through said open top, said housing having a passage, control valve means mounted on the cap and housing operable to control the flow of propellant and materials from said passage, said control valve means being normally closed and having a moveable body extended into the passage which can be moved to open said valve means whereby propellant and material are dispensed from the container, porous filter means mounted on the housing to prevent foreign particles from flowing into the passage whereby when the valve means is open the propellant and material in said chamber flow through the filter into the passage, frangible ampule means located within said chamber generally along the diagonal length of the chamber for storing a second material separate from the first material until the ampule means is broken, holder means mounted on the container and extended into said chamber having a sleeve with a passage accommodating a portion of the ampule means, said holder means having an inwardly and downwardly sloping side wall, push rod means connected to the body and extended through the housing and filter means being supported and guided thereby, said push rod means having an end located contiguous to the side wall of the holder means adjacent the sleeve and ampule means whereby when the body is moved to first open the valve means the side wall guides the push rod means downwardly moving the end of the push rod into engagement with the ampule means thereby breaking the ampule means so that the second material is mixed with the first material in the chamber.

35. The dispenser of claim 34 including: biasing means engageable with the moveable body and housing to bias the valve means to a closed position, said biasing means and housing and filter means holding the end of the push rod in engagement with the side wall of the holder means adjacent the sleeve and ampule means.

36. The dispenser of claim 34 wherein: said push rod means includes a downwardly directed conical shaped finger adjacent the ampule means, said finger engaging an inner surface of the side wall of the holder means when the valve means is in a closed position.

37. The dispenser of claim 34 wherein: the filter means has a bottom wall having a hole, said push rod extended through said hole and housing with a sliding fit.

38. The dispenser of claim 34 including: a bracket member secured to the holder means extending downwardly generally member having a base accommodating a lower end of the ampule means, said-base located below the holder means and projecting normal to the longitudinal axis of the bracket member whereby the ampule means is retained in the holder means and said chamber generally along the diagonal length of the chamber.

39. The dispenser of claim 38 wherein: the bracket member includes a pair of convex curved arms adapted to grip the lower end of the ampule means.

40. The dispenser of claim 34 including: means for preventing the dispensing of propellant and materials when the control valve means is first moved to the open position to break the ampule means.

41. The dispenser of claim 40 including: nozzle means having a discharge spout connected to the valve means for receiving propellant and materials and directing propellant and materials to a selected location, said means for preventing the dispensing of propellant and materials including cap means mounted on the nozzle means for preventing propellant and materials from being discharged from the nozzle means during the breaking of the ampule means, said cap means being removable from said nozzle means thereby allowing propellant and materials to be discharged from the nozzle means when the valve means is open.

42. The dispenser of claim 41 wherein: said cap means has a sleeve with a blind hole, said nozzle means having a portion thereof, located within said blind hole.

43. A dispenser comprising: a container having an internal chamber for storing a propellant and at least one first component to be sprayed therefrom, normally closed valve means mounted on said container to retain the propellant and component in said chamber, said valve means being moveable to an open position to dispense material to a desired location, filter means mounted on the valve means to prevent foreign particles from flowing into the valve means, frangible ampule means located within said chamber containing a second component that is separated from the first component within the chamber until said ampule means is broken, means for holding the ampule means in said chamber, said means for holding the ampule means in said chamber comprising a holder mounted on the container having a sleeve having a passage accommodating an end portion of the ampule means, said sleeve having a longitudinal axis generally parallel to the diagonal axis of said chamber, and a bracket member secured to the holder extending downwardly generally parallel to the longitudinal axis of said sleeve, said bracket member having a base accommodating a lower end of the ampule means whereby the ampule means is retained in the holder and said chamber generally along the diagonal length of the chamber, means mounted on said valve means extended through the filter means and engageable with said ampule means to break said ampule means when the valve means is first moved to the open position thereby releasing the second component into said chamber whereby the first and second components are mixed together, and means for preventing the dispensing of propellant and materials when the control valve means is first moved to the open position to break the ampule means.

44. The dispenser of claim 43 wherein: the means mounted on said valve means extended through the filter and engageable with said ampule means includes a push rod, the push rod being supported and guided by the filter.

45. The dispenser of claim 43 wherein: said holder has vent hole means allowing thorough mixing of the first and second materials when the ampule is broken.

46. The dispenser of claim 43 wherein: the bracket member includes a pair of convex curved arms adapted to grip the lower end of the ampule means.

47. The dispenser of claim 43 including: nozzle means having a discharge spout connected to the valve means for receiving propellant and materials and directing propellant and materials to a selected location, said means for preventing the dispensing of propellant and materials including cap means mounted on the nozzle means for preventing propellant and materials from being discharged from the nozzle means during the breaking of the ampule means, said cap means being removable from said nozzle means thereby allowing propellant and materials to be discharged from the nozzle means when the valve means is open.

48. The dispenser of claim 47 wherein: said cap means has a sleeve with a blind hole, said nozzle means having a portion thereof located within said blind hole.

49. The dispenser of claim 47 including: a cover mounted on the nozzle means to prevent accidental dispensing of propellant and materials from the container and rupture of the ampule means.

* * * * *